US008224509B2

(12) United States Patent
Jeter et al.

(10) Patent No.: US 8,224,509 B2
(45) Date of Patent: Jul. 17, 2012

(54) LINEAR SYNCHRONOUS MOTOR WITH PHASE CONTROL

(75) Inventors: Philip Lynn Jeter, San Diego, CA (US); Karoly Kehrer, Midland, PA (US); Husam Gurol, Carlsbad, CA (US)

(73) Assignee: General Atomics, San Diego, CA (US)

( * ) Notice: Subject to any disclaimer, the term of this patent is extended or adjusted under 35 U.S.C. 154(b) by 1005 days.

(21) Appl. No.: 11/843,507

(22) Filed: Aug. 22, 2007

(65) Prior Publication Data

US 2008/0086244 A1 Apr. 10, 2008

Related U.S. Application Data

(60) Provisional application No. 60/839,933, filed on Aug. 25, 2006.

(51) Int. Cl.
*B60L 13/06* (2006.01)

(52) U.S. Cl. ..... 701/19; 701/20; 104/18; 104/281; 104/282; 104/283; 104/284

(58) Field of Classification Search ..... 104/281–305, 104/154–161; 105/35, 49–61; 701/1, 19, 701/20, 22–27; 310/10; 318/437
See application file for complete search history.

(56) References Cited

U.S. PATENT DOCUMENTS 2,468,090 A 4/1949 Lundburg
3,197,775 A 7/1965 Sendler
3,362,024 A 1/1968 Badewitz
3,712,240 A * 1/1973 Donlon et al. ..... 104/292
4,061,089 A * 12/1977 Sawyer ..... 104/23.2
4,179,744 A * 12/1979 Lowe ..... 701/33.7
4,283,031 A * 8/1981 Finch ..... 246/128
4,603,640 A * 8/1986 Miller et al. ..... 104/282
4,607,203 A * 8/1986 Bohm et al. ..... 318/687
4,728,959 A 3/1988 Maloney et al.
5,053,654 A * 10/1991 Augsburger et al. ..... 310/12.09
5,141,183 A * 8/1992 Jurkowski et al. ..... 246/167 M
5,187,485 A 2/1993 Tsui et al.
5,225,726 A * 7/1993 Tozoni ..... 310/12.09
5,395,078 A * 3/1995 Gellender ..... 246/249
5,417,388 A * 5/1995 Stillwell ..... 246/122 R
5,497,038 A * 3/1996 Sink ..... 310/12.09
5,569,987 A * 10/1996 Fischperer ..... 318/135
5,596,330 A 1/1997 Yokev et al.
5,601,029 A * 2/1997 Geraghty et al. ..... 104/284
5,606,256 A * 2/1997 Takei ..... 324/207.21
5,676,337 A * 10/1997 Giras et al. ..... 246/182 A
5,746,399 A * 5/1998 Ehrlich et al. ..... 246/122 R
5,803,411 A * 9/1998 Ackerman et al. ..... 246/169 R
5,823,481 A * 10/1998 Gottschlich ..... 246/28 R
5,825,177 A * 10/1998 Finnestad et al. ..... 324/179
5,828,979 A * 10/1998 Polivka et al. ..... 701/117
5,947,423 A * 9/1999 Clifton et al. ..... 246/62
6,043,774 A * 3/2000 Singh et al. ..... 342/127
6,135,396 A * 10/2000 Whitfield et al. ..... 246/182 R (Continued)

*Primary Examiner* — Jonathan M Dager
(74) *Attorney, Agent, or Firm* — Nydegger and Associates

(57) ABSTRACT

A system for controlling movements of a vehicle along a guideway includes an array of targets that are mounted on the vehicle, and a series of wayside sensors that are mounted on the guideway. A signal processor monitors the passage of targets past appropriate sensors and uses resultant signals to derive parametric values that are characteristic of the vehicle's movements. The parametric values are then coordinated with a controller for the operation of a linear synchronous motor that propels the vehicle.

17 Claims, 1 Drawing Sheet

U.S. PATENT DOCUMENTS 6,170,402 B1 * 1/2001 Rude et al. ..... 104/53
6,357,359 B1 * 3/2002 Davey et al. ..... 104/282
6,371,417 B1 * 4/2002 Southon ..... 246/247
6,411,049 B1 * 6/2002 Fischperer ..... 318/38
6,439,513 B1 * 8/2002 Pascoe ..... 246/122 R
6,499,701 B1 * 12/2002 Thornton et al. ..... 246/194
6,663,053 B1 * 12/2003 Shams ..... 246/249
6,677,890 B2 1/2004 Halsey et al.
6,781,524 B1 * 8/2004 Clark et al. ..... 340/933
7,269,487 B2 * 9/2007 Watanabe et al. ..... 701/19
7,448,327 B2 * 11/2008 Thornton et al. ..... 104/282
7,481,400 B2 * 1/2009 Appleby et al. ..... 246/249
7,671,757 B2 * 3/2010 Mathews et al. ..... 340/686.1
7,737,686 B2 * 6/2010 Schmid et al. ..... 324/207.26
7,825,802 B2 * 11/2010 Baiker et al. ..... 340/572.1
7,835,830 B2 * 11/2010 Ellmann et al. ..... 701/19
2003/0005851 A1 * 1/2003 Post ..... 104/281
2003/0006871 A1 * 1/2003 Post ..... 335/306
2003/0217668 A1 * 11/2003 Fiske et al. ..... 104/282
2003/0236598 A1 * 12/2003 Villarreal Antelo et al. ... 701/19
2005/0178632 A1 * 8/2005 Ross ..... 191/10
2007/0089636 A1 * 4/2007 Guardo, Jr. ..... 104/281
2008/0086244 A1 * 4/2008 Jeter et al. ..... 701/19
2008/0148990 A1 * 6/2008 Wamble et al. ..... 104/281
2008/0203735 A1 * 8/2008 Leslie ..... 291/3
2008/0315044 A1 * 12/2008 Stull et al. ..... 246/5
2009/0090818 A1 * 4/2009 Kumar ..... 246/186
2009/0099715 A1 * 4/2009 Cho et al. ..... 701/20
2010/0060269 A1 * 3/2010 Schmid ..... 324/207.11

* cited by examiner

LINEAR SYNCHRONOUS MOTOR WITH PHASE CONTROL

CROSS-REFERENCE TO RELATED APPLICATIONS

This application claims the benefit of U.S. Provisional Patent Application Ser. No. 60/839,933, filed Aug. 5, 2006.

FIELD OF THE INVENTION

The present invention pertains generally to transportation systems (e.g. trains) that move heavy objects, such as cargo and passengers, over long distances. More particularly, the present invention pertains to transportation control systems that use stationary, land-based sensors to monitor the movements of a vehicle. The present invention is particularly, but not exclusively useful as a vehicular control system wherein external sensors provide parametric values for coordinating the operation of a vehicle's propulsion system with its movements along a guideway.

BACKGROUND OF THE INVENTION

As is well known, the basic components of a Linear Synchronous Motor (LSM) correspond to the standard rotor and stator components of an electric motor. Specifically, the operational interaction of these components are correspondingly similar. Unlike a standard electric motor, however, the components of an LSM are laid out substantially in-line. Such a configuration lends itself well for use as a propulsion unit for a vehicle that is designed to travel long distances (e.g. a train). For example, such a system might use a vehicle-based rotor, and a land-based stator.

Several advantages can be mentioned for using a hard wire, land-based stator as part of the propulsion unit for a long distance vehicle. For one, in general, the land-based stator will not be influenced by weather conditions or terrain variations (e.g. mountains and valleys) that might otherwise interfere with the reception of radiated signals. For another, it is not affected by vehicle travel through tunnels or other such obstructions. Moreover, by having a hard wire stator, it has been determined that an LSM can be made effectively impervious to electromagnetic interference (EMI) and noise.

Despite the many advantages that can be mentioned for an LSM, the motor has its sensitivities. In particular, it is also important to note that maintenance of the motor phase angle (i.e. the electrical phase angle between the vehicle-based rotor and the land-based stator) is crucial. Maximum thrust for a vehicle propelled by an LSM is achieved when the motor phase angle is maintained at ninety degrees (90°). Otherwise, motor operation can be significantly degraded, with unstable motor fluctuations and possible stoppage. The cure, however, is to have control over the spatial relationship between the rotor and the stator. Stated differently, it is necessary to know the position of the vehicle-based rotor (i.e. the vehicle itself), relative to the fixed, land-based stator.

In light of the above, it is an object of the present invention to provide a system and method for controlling movements of a vehicle along a land-based guideway, where the vehicle uses a propulsion unit (LSM) with its motor phase angle controlled by vehicle position. Another object of the present invention is to provide a system and method for controlling the motor phase angle of an LSM that is robust and can be used with either a wheeled or levitated vehicle. Still another object of the present invention is to provide a system and method for controlling the motor phase angle of an LSM that is reliable and resistant to high levels of wide band electromagnetic interference. Yet another object of the present invention is to provide a system for controlling movements of a vehicle along a land-based guideway that is relatively easy to manufacture, is simple to use and is comparatively cost effective.

SUMMARY OF THE INVENTION

In accordance with the present invention, a system and method for controlling movements of a vehicle along a guideway employs an external land-based monitor. Specifically, the monitor has sensors, and it has a signal processor. Respectively, the sensors and the signal processor detect and determine parametric values that are indicative of the vehicle's movements. These parametric values are then used to coordinate vehicle movement with the operation of its propulsion unit (i.e. a linear synchronous motor). The purpose here is to achieve optimal operation of the propulsion unit by maintaining the motor phase angle (i.e. the phase angle between the vehicle-based rotor and the land-based stator) as close to 90° as possible.

In detail, the system of the present invention requires that a linear array of targets be mounted on the vehicle. In the array, each target is positioned at a known distance "d" from adjacent targets, and all of the targets in the array are aligned through a length "l". The system and method of the present invention also requires that a first plurality of wayside sensors (i.e. the monitor) be placed along the guideway on which the vehicle will travel. These wayside sensors of the first plurality are separated from each other by a spacing "s". As envisioned by the present invention, a second plurality of wayside sensors may also be employed. If so, each sensor of the second plurality is placed midway between adjacent sensors of the first plurality. For the present invention, each sensor (primary and secondary) is electronically connected to a signal processor.

In the operation of the present invention, each wayside sensor will generate a signal whenever a target in the array on the vehicle passes within a predetermined range from the sensor. This signal is then passed to the signal processor. At the signal processor, parametric values that are characteristic of the movement of the vehicle can be derived. In particular, a computer in the signal processor can measure a time interval "$\Delta t$" between successive signals. Further, because the distance "d" between adjacent targets in the array is known, a speed for the vehicle can be determined using "d" and "$\Delta t$". It also happens that by monitoring signals from successive sensors, the acceleration, speed and position of the vehicle on the guideway can also be determined by the signal processor.

Structurally, the targets in the array on the vehicle, and the wayside sensors that are placed along the guideway need to be geometrically related. With this requirement in mind, consider the relationships between the length "l" of the array, the distance "d" between targets in the array, and the spacing "s" between sensors along the guideway. With regard to the length "l" of the array, it is important that it be greater than the spacing "s" between wayside sensors ($l>s$). This is so in order to provide overlap, and to insure that each sensor will be responsive to at least two adjacent targets during the time interval "$\Delta t$".

The relationship between "s" and "d" will, in part, help determine the types of targets and sensors that are to be used. For example, in a first preferred embodiment, the distance "d" between targets in the array is less than the spacing "s" between wayside sensors ($d<s$) along the guideway. Thus, fewer sensors are needed. In this embodiment, the wayside sensors may be relatively more expensive eddy current sensors, and the targets on the vehicle can be relatively inexpensive metal bars. For an alternate preferred embodiment, the distance "d" between targets in the array is greater than "s" (d>s). In this case, the wayside sensors may be relatively less expensive "hall effect" sensors, and the targets on the vehicle can be magnets.

As mentioned above, the present invention envisions a propulsion unit for the vehicle that is a linear synchronous motor of a type well known in the pertinent art. More particularly, the present invention envisions the signal processor will include a computer that is capable of deriving parametric values with input from the monitor (i.e. the sensor signals). These parametric values (including speed and position of the vehicle) are then sent to a controller that will control a phase angle of the linear synchronous motor, to thereby optimize operation of the linear synchronous motor.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
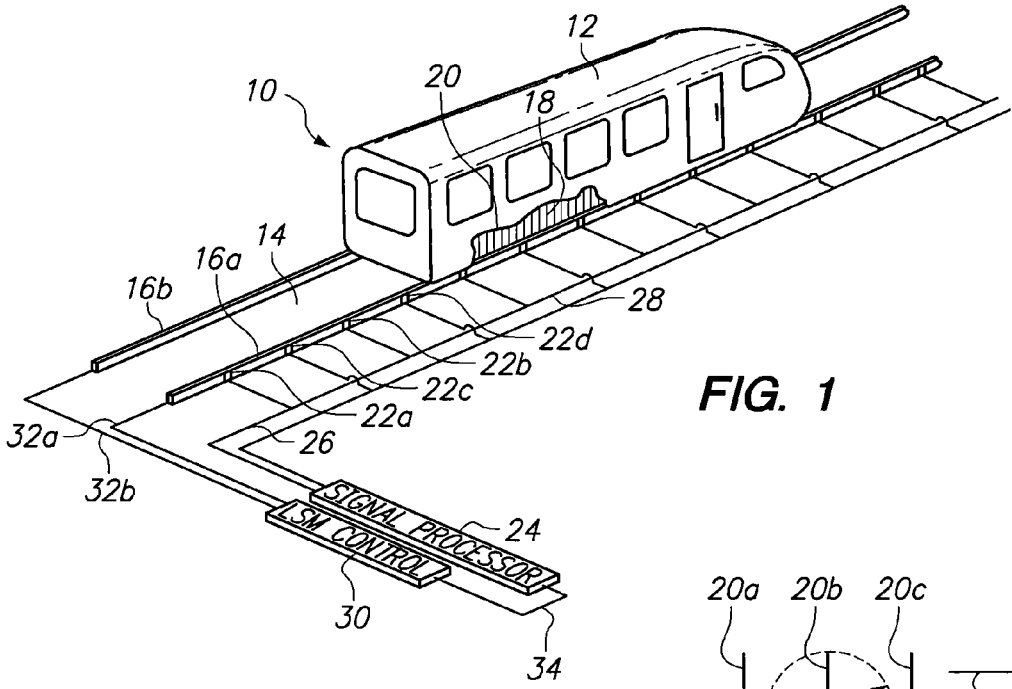
FIG. 1 is a perspective view of a vehicle using the system of the present invention, with portions broken away for clarity.

Referring initially to FIG. 1 a system in accordance with the present invention is shown and is generally designated 10. As shown, the system 10 includes a vehicle 12 that is positioned to travel along a guideway 14. As envisioned for the present invention, the vehicle 12 may be any of several types well known in the pertinent art. Preferably, vehicle 12 is of the maglev type. In any case, the vehicle 12 will travel along rails 16 in the guideway 14, of which the rails 16*a* and 16*b* are exemplary. Also, the vehicle 12 will include an array 18 of targets 20 that are affixed to, or mounted on, the vehicle 12. Preferably, the array 18 is linear and, for the configuration shown in FIG. 1, the targets 20 in the array 18 are aligned so they are substantially parallel to the rail 16*a*.

Still referring to FIG. 1 it will be seen that the system 10 also includes a plurality of wayside sensors 22, of which the sensors 22*a*, 22*b*, 22*c* and 22*d* are exemplary. As shown, the wayside sensors 22 are placed in-line along a rail 16 of the guideway 14 (placement along the rail 16*a* is illustrated). Further, as shown, two different sets of these sensors 22 can be placed along the rail 16*a*. A first set of sensors 22 (also referred to herein as primary sensors) will be connected to a signal processor 24 via a common line 26. The sensors 22*a* and 22*b* are shown to be primary sensors. On the other hand, a second set of sensors 22 (i.e. secondary sensors 22*c* and 22*d*) will be connected to the signal processor 24 via another common line 28. When the two sets of sensors 22 are used, they intermesh with each other. Stated differently, each primary sensor (22*a* or 22*b*) is placed midway between adjacent secondary sensors (e.g. 22*c* and 22*d*), and vice versa. Thus, as arranged, the sensors 22 can provide redundancy for the system 10.

FIG. 1 also shows that the system 10 includes a control 30 for a Linear Synchronous Motor (LSM) (not shown). More specifically, the LSM control 30 is used to move the vehicle 12 in a manner well known in the pertinent art. This propulsion of the vehicle 12 is possible, due to connections between LSM control 30 and the rail 16*a* via line 32*a*, and/or rail 16*b* via line 32*b*. Importantly, for the system 10 of the present invention, LSM control 30 uses input from the signal processor 24 for its operation. This interconnection is accomplished by line 34 shown between the signal processor 24 and the LSM control 30 in FIG. 1. The exact nature of the input provided by signal processor 24 for the operation of LSM control 30 will, however, be best appreciated with reference to FIGS. 2A and 2B.

Figure 2A:
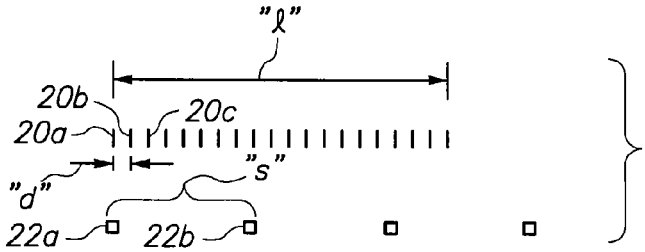
FIG. 2A is a schematic drawing of a first relationship between a target array on the vehicle and sensor placement along the guideway for the present invention.

With specific reference to FIG. 2A, it is to be appreciated that the targets 20 in an array 18 will be aligned to extend through a length "l". The exact measure of length "l" is somewhat arbitrary and is primarily a matter of design choice. Indeed, the length "l" of the array 18 is preferred to be as long as the vehicle 12. The distance "d" between targets 20, however, is not arbitrary. For the example shown in FIG. 2A, it is important that the distance "d" between targets 20*a* and 20*b*, be known with certainty. The same applies to all corresponding distances "d" between any other pair of adjacent targets 20 in the array 18. Recall, the targets 20 in array 18 are mounted on the vehicle 12. The sensors 22*a* and 22*b* shown in FIG. 2A, however, are land-based. Specifically, they are placed along the guideway 14 (see FIG. 1). As shown in FIG. 2A, there is a spacing "s" between adjacent sensors 22.

Still referring to FIG. 2A, several important relationships between "l", "s" and "d" must be noted. For one, the spacing "s" between sensors 22 is preferably shorter than the length "l" of the array 18. This is so to insure that a target 20 in the array 18 is always interacting with a sensor 22. Further, for operational reasons discussed below, the distance "d" between targets 20 in the array 18 must be known with certainty. The importance of these relationships will be best appreciated with reference to FIG. 3.

Figure 3:
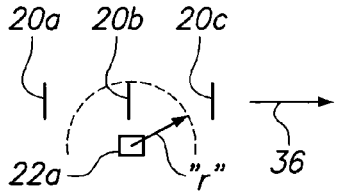
FIG. 3 is a schematic drawing of a single sensor positioned for response to a single target.

In FIG. 3, targets 20*a*, 20*b*, and 20*c* are selected from an array 18 and are shown as though traveling with a vehicle 12 in the direction indicated by the arrow 36. On the other hand, it is important to appreciate that the wayside sensor 22*a* shown in FIG. 3 is stationary. Recall, all of the wayside sensors 22 are placed in-line along the guideway 14. Further, as intended for the present invention, each sensor 22 will interact with each target 20 as the target 20 passes the particular sensor 22. Specifically, the system 10 of the present invention envisions that a sensor (e.g. sensor 22*a*) will send a signal via line 26 to the signal processor 24 whenever a target 20 (e.g. target 20*b*) is within a range "r" of the sensor 22*a*. Moreover, the present invention envisions this signal will peak when a target 20 is at its closest to a sensor 22. In any event, each sensor 22 will send a signal to the signal processor 24 each time a target 20 passes the sensor 22 within the range "r". For the example shown in FIG. 3, sensor 22*a* previously sent a signal to the signal processor 24 when the target 20*c* was within range "r". It is presently shown in a circumstance for sending a signal indicating the passage of target 20*b*. The sensor 22*a* will also send another signal when the target 20*a* passes the sensor 22*a*. In turn, each sensor 22 will do this, regardless whether it is a primary sensor (e.g. sensor 22*a*) or a secondary sensor (e.g. sensor 22*c*). Importantly, in each case, the distance between targets 20*b* and 20*c* is "d", and the distance between targets 20*a* and 20*b* is the same "d".

Figure 2B:
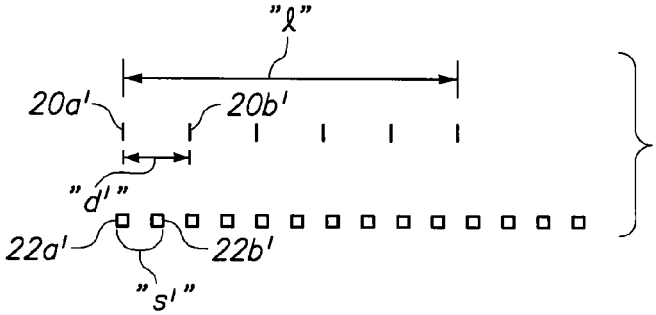
FIG. 2B is a schematic drawing of a second relationship between a target array on the vehicle and sensor placement along the guideway for the present invention.

FIG. 2A shows an embodiment for the system 10 wherein the distance "d" between targets 20 on the vehicle 12 is less than the spacing "s" between sensors 22 on the guideway 14 (d<s). In this configuration, fewer sensors 22, but more targets 20, may be desired. This embodiment lends itself to the use of relatively more expensive eddy current sensors 22, with less expensive metal bar targets 20. For an alternate embodiment, FIG. 2B shows a system 10 wherein the distance "d'" between targets 20*a*' and 20*b*' on the vehicle 12 is more than the spacing "s'" between sensors 22*a*' and 22*b*' on the guideway 14 (d>s). In this case the perceptions are reversed. For example, more less expensive "hall effect" sensors 22' can be used with fewer, but relatively more expensive, magnetic targets 20'.

In the operation of the system 10 of the present invention, it is essential to recall that the distance "d" between targets 20 in the array 18 is known, and is the same for all targets 20. Further, as the vehicle 12 moves along the guideway 14 (e.g. in the direction of arrow 36), a sensor 22 (e.g. 22*a*, regardless of type) will be able to determine a time interval "Δt" (i.e. time interval) between the passage of successive targets 20 (e.g. 22*c* and 22*b*). Signal processor 24 can then use these measurements to derive parametric values, such as the velocity of vehicle 12, to characterize the movements of the vehicle 12. In turn, the present invention envisions passing the derived parametric values for the signal processor 24 to the LSM control 30 for phase angle control of a linear synchronous motor (not shown), to control movements of the vehicle 12 and optimize operation of the system 10.

While the particular Linear Synchronous Motor with Phase Control as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A system for controlling movements of a vehicle along a land-based guideway which comprises:

a linear array of targets mounted on the vehicle, wherein the array has a length (l), with a predetermined distance (d) between adjacent targets, wherein the targets of the array are aligned in the direction of vehicle movement;

a plurality of stationary, in-line, wayside sensors placed along the guideway with a spacing (s) between adjacent sensors;

a signal processor electronically connected to each sensor to receive a signal therefrom, wherein the signal is indicative of a target being within a predetermined range (r) from a sensor;

a computer means connected with the signal processor for measuring a time interval (Δt) between successive signals to derive parametric values, based on (Δt) and (d);

a propulsion unit, wherein operation of the propulsion unit is characterized by a motor phase angle; and a controller connected to the computer for receiving the parametric values therefrom, wherein the controller controls the motor phase angle of the propulsion unit, based on the parametric values received from the computer, to control the propulsion of the vehicle.

2. A system as recited in claim 1 wherein the array of targets defines a target ladder oriented substantially perpendicular to the in-line, wayside sensors.

3. A system as recited in claim 1 wherein the distance "d" between targets in the array is less than the spacing "s" between wayside sensors (d<s), wherein the wayside sensors are eddy current sensors, and further wherein the targets on the vehicle are metal bars.

4. A system as recited in claim 1 wherein the predetermined distance (d) between targets in the array is greater than the spacing (s) (d>s), wherein the wayside sensors are hall effect sensors and the targets on the vehicle are magnets.

5. A system as recited in claim 1 wherein the controller is a linear synchronous motor control.

6. A system as recited in claim 1 wherein the length (l) of the array is greater than the spacing (s) between wayside sensors (l>s) to provide overlap and insure each sensor is responsive to at least two adjacent targets in the array during the time interval (Δt).

7. A system as recited in claim 1 wherein the sensors are primary sensors and the system further comprises a plurality of secondary sensors mounted on the guideway, with each secondary sensor positioned substantially midway between a pair of adjacent primary sensors.

8. A system as recited in claim 7 wherein the signal processor successively receives signals from the primary sensors and from the secondary sensors to determine a direction of travel for the vehicle.

9. A system as recited in claim 1 wherein the signal processor monitors sensor activity to determine a location of the vehicle.

10. A system as recited in claim 1 wherein the wayside sensors are respectively grouped in a plurality of blocks of contiguous sensors to determine a location of the vehicle in a particular block.

11. A system for controlling movements of a vehicle along a land-based guideway which comprises:

a plurality of stationary wayside sensors placed along the guideway for detecting passage of the vehicle past a predetermined sensor, and for generating at least two signals in response thereto, wherein each signal indicates passage of a respective target on the vehicle, and wherein there is a predetermined distance (d) in the direction of vehicle movement between targets on the vehicle;

a signal processor for receiving the signals from the predetermined sensor to derive parametric values characteristic of the movement of the vehicle;

a computer means connected with the signal processor for measuring a time interval (Δt) between successive signals to derive parametric values, based on (Δt) and (d);

a propulsion unit, wherein operation of the propulsion unit is characterized by a motor phase angle; and a controller connected to the computer means for receiving the parametric values therefrom, wherein the controller controls the motor phase angle of the propulsion unit, based on the parametric values received from the computer means, to control movement of the vehicle.

12. A system as recited in claim 11 further comprising:

a linear array of targets mounted on the vehicle, wherein the array has a length (l), with the predetermined distance (d) between adjacent targets and, wherein the targets of the array are aligned in the direction of vehicle movement.

13. A system as recited in claim 12 wherein the wayside sensors are mounted on the guideway with a spacing (s) between adjacent sensors, and wherein the signal processor is electronically connected to each sensor to receive a signal therefrom, wherein the signal is indicative of a target being within a predetermined range (r) from a sensor.

14. A system as recited in claim 13 wherein the distance "d" between targets in the array is less than the spacing "s" between wayside sensors (d<s), wherein the wayside sensors are eddy current sensors, and further wherein the targets on the vehicle are metal bars.

15. A system as recited in claim 13 wherein the predetermined distance (d) between targets in the array is greater than the spacing (s) (d>s), wherein the wayside sensors are hall effect sensors and the targets on the vehicle are magnets.

16. A system as recited in claim 11 wherein the signal processor monitors sensor activity to determine a location of the vehicle.

17. A system as recited in claim 11 wherein the wayside sensors are respectively grouped in a plurality of blocks of contiguous sensors to determine a location of the vehicle in a particular block.

* * * * *